US008418344B1

(12) United States Patent
Letney

(10) Patent No.: US 8,418,344 B1
(45) Date of Patent: Apr. 16, 2013

(54) METHOD OF ASSEMBLING A CEREMONIAL MULTI-PIECE SCULPTURE

(76) Inventor: Michael James Letney, Tulsa, OK (US)

( * ) Notice: Subject to any disclaimer, the term of this patent is extended or adjusted under 35 U.S.C. 154(b) by 224 days.

(21) Appl. No.: 12/836,963

(22) Filed: Jul. 15, 2010

Related U.S. Application Data

(63) Continuation-in-part of application No. 29/354,164, filed on Jan. 20, 2010, now Pat. No. Des. 619,926.

(51) Int. Cl.
*A47G 33/02* (2006.01)

(52) U.S. Cl.
USPC ..... 29/525.11; 29/525.01; 52/103; 428/3; 428/542.2

(58) Field of Classification Search ..... 29/525.01, 29/525.11, 428; 40/1, 124.01, 411, 421, 40/446, 584, 700; 52/31.3, 103, 311.1, 613; 428/3, 39, 53, 13, 542.2
See application file for complete search history.

(56) References Cited

U.S. PATENT DOCUMENTS

| | | | | |
|---|---|---|---|---|
| 274,638 | A * | 3/1883 | Mould | 52/103 |
| 2,355,154 | A * | 8/1944 | Goudreau | 428/3 |
| 2,533,778 | A * | 12/1950 | Eckhardt | 40/734 |
| 8,038,309 | B2 * | 10/2011 | Yang | 362/101 |

* cited by examiner

*Primary Examiner* — David Bryant
*Assistant Examiner* — Steven A Maynard
(74) *Attorney, Agent, or Firm* — Head, Johnson & Kachigian, P.C.

(57) ABSTRACT

A multi-piece ceremonial sculpture when assembled creates a symbol for unity during a wedding ceremony or anniversary or business celebration. The method of assembling the sculpture is to fasten an outer cross-shaped piece to a solid base through peg holes. Once the outer cross-shaped piece has been secured, then an inner piece will be secured within the outer piece by placing plugs through the openings on the top and sides. Once assembled, the sculpture displays a complete piece of art commemorating the commitment to the union.

8 Claims, 7 Drawing Sheets

METHOD OF ASSEMBLING A CEREMONIAL MULTI-PIECE SCULPTURE

REFERENCE TO PENDING APPLICATION

This application is a continuation-in-part of the U.S. Design patent application Ser. No. 29/354,164 filed Jan. 20, 2010, entitled Unity Cross Multi-Piece Sculpture.

BACKGROUND OF THE INVENTION

1. Field of the Invention

The present invention is a method of assembling a ceremonial multi-piece sculptural device, that when assembled creates a symbol of unity during a wedding ceremony, anniversary, or business celebration.

2. Prior Art

In the past there have been various ceremonial rituals with candles and other devices in order to commemorate weddings, business unions and ceremonies.

The present invention is unique in its design to symbolize unity and commitment during a wedding or other celebration.

SUMMARY OF THE INVENTION

The present invention is directed to a method of assembly of a ceremonial multi-piece sculpture.

There are many different types of rituals and pieces that can be used during wedding ceremonies or other types of celebrations. A cross is often used as a symbol of unity and spiritual meaning during ceremonies. The multi-piece sculpture evokes and affirms the marriage commitment made within the church and its vows or the honorable commitment made between two individuals during a celebration or business meeting.

In at least one embodiment, the present invention provides a method of assembling a ceremonial multi-piece sculpture, composed of outer and inner components shaped like a cross along with a sturdy base to hold the assembly together.

The outer piece is shaped like a cross and contains pegs that firmly secure the outer piece to the solid base structure. The outer piece can represent a "Man" while the more intricate inner piece can represent a "Woman." The design and function is meant to be unique and when properly assembled in the ceremony or celebration, a unifying sculpture is created. The inner piece is firmly fitted within the outer piece and secured with plastic pegs that are inserted through aligned openings on the top and sides. An optional drawer may be inserted into the base to hold scriptures and other ceremonial materials.

After the cross is properly assembled, the sculpture resembles the shared commitment or unity on the same principles between two people and acts as a daily reminder of the commitments.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

The present invention provides for a method or process to assemble a ceremonial multi-piece sculpture.

Figure 1:
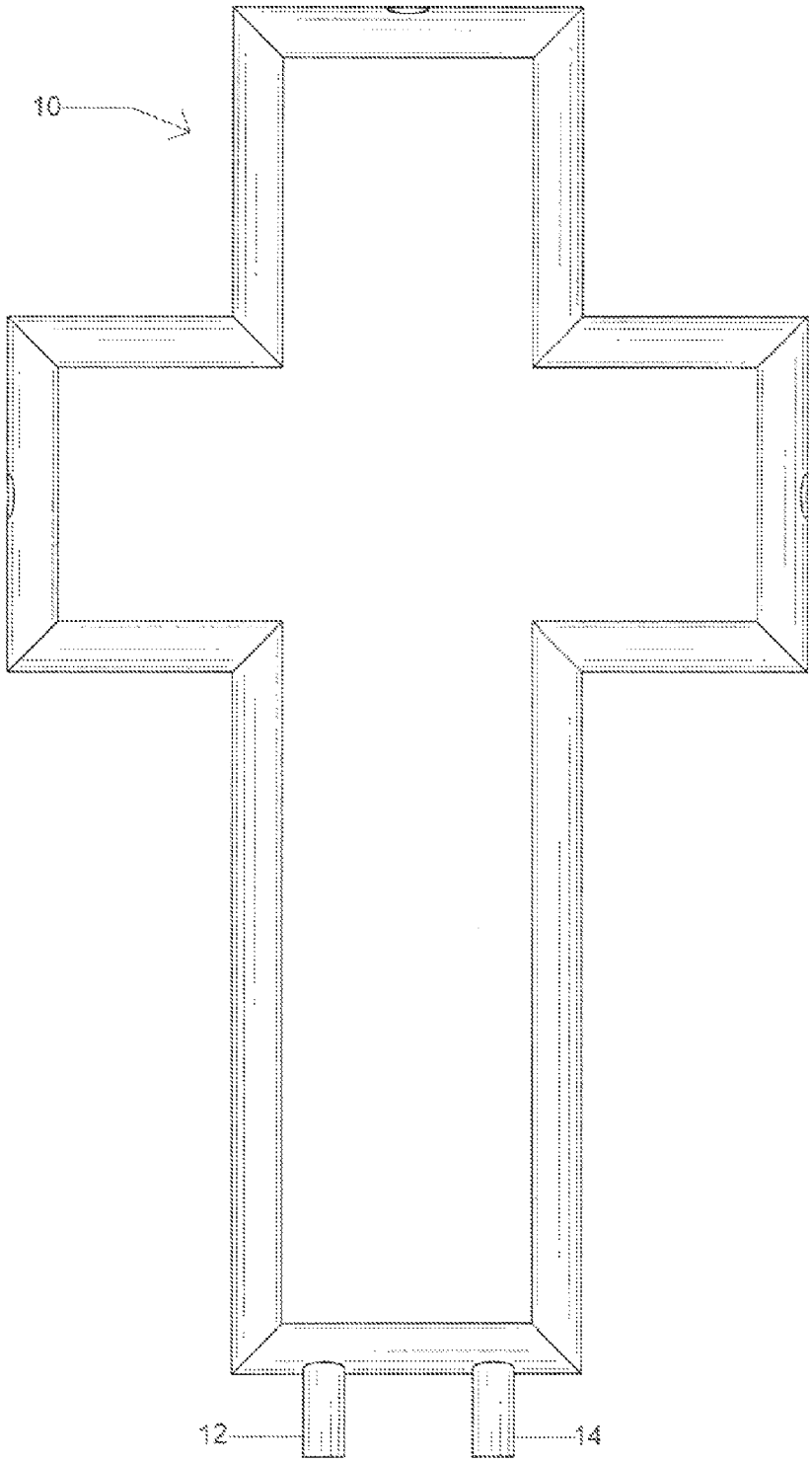
FIG. 1 illustrates a front view of an outer piece of a multi-piece sculpture in accordance with the present invention.

As shown in FIG. 1, an outer piece 10 is shaped in the outline of a cross and may be brought to the ceremony by one of the parties, and also could represent a "Man" within a wedding ceremony. The outer piece 10 may be composed of a sturdy plastic material that is firm enough to not easily be knocked down, and is open in the middle so that an inner piece 30 (not shown in FIG. 1) can fit within. As shown in FIG. 1, the outer piece 10 contains two circular pegs 12 and 14 that protrude out of the bottom of the cross-shaped outer piece 10.

Figure 2:
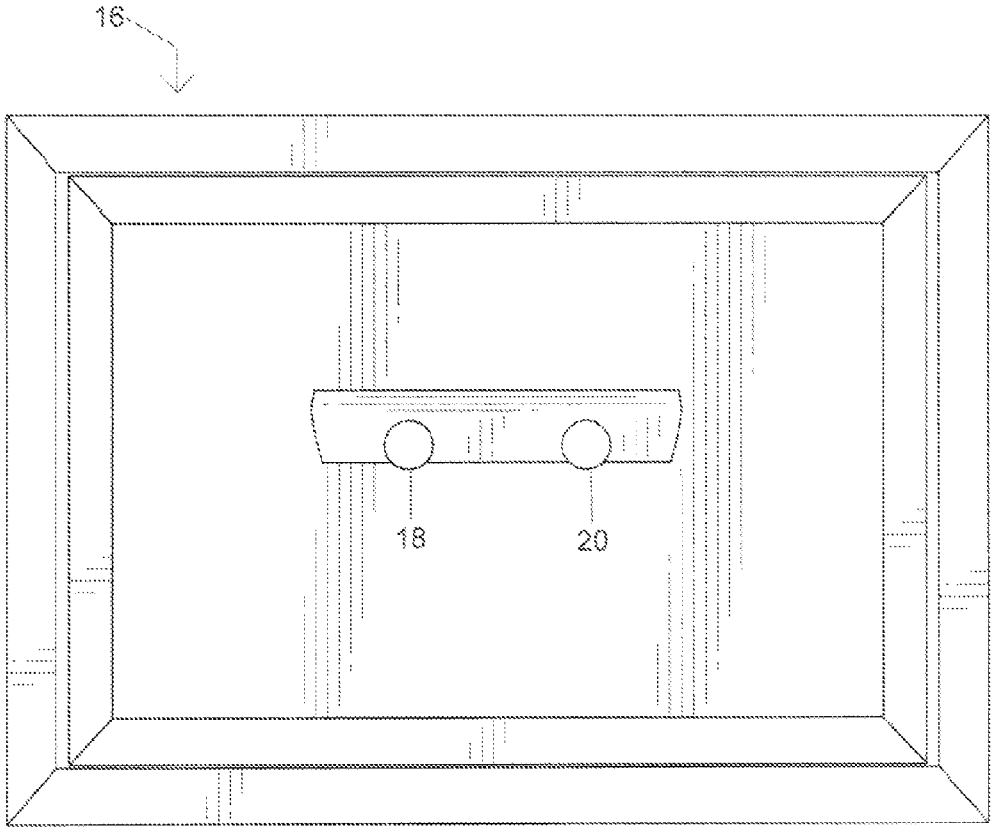
FIG. 2 illustrates a top view of a base piece of the multi-piece sculpture.
Figure 3:
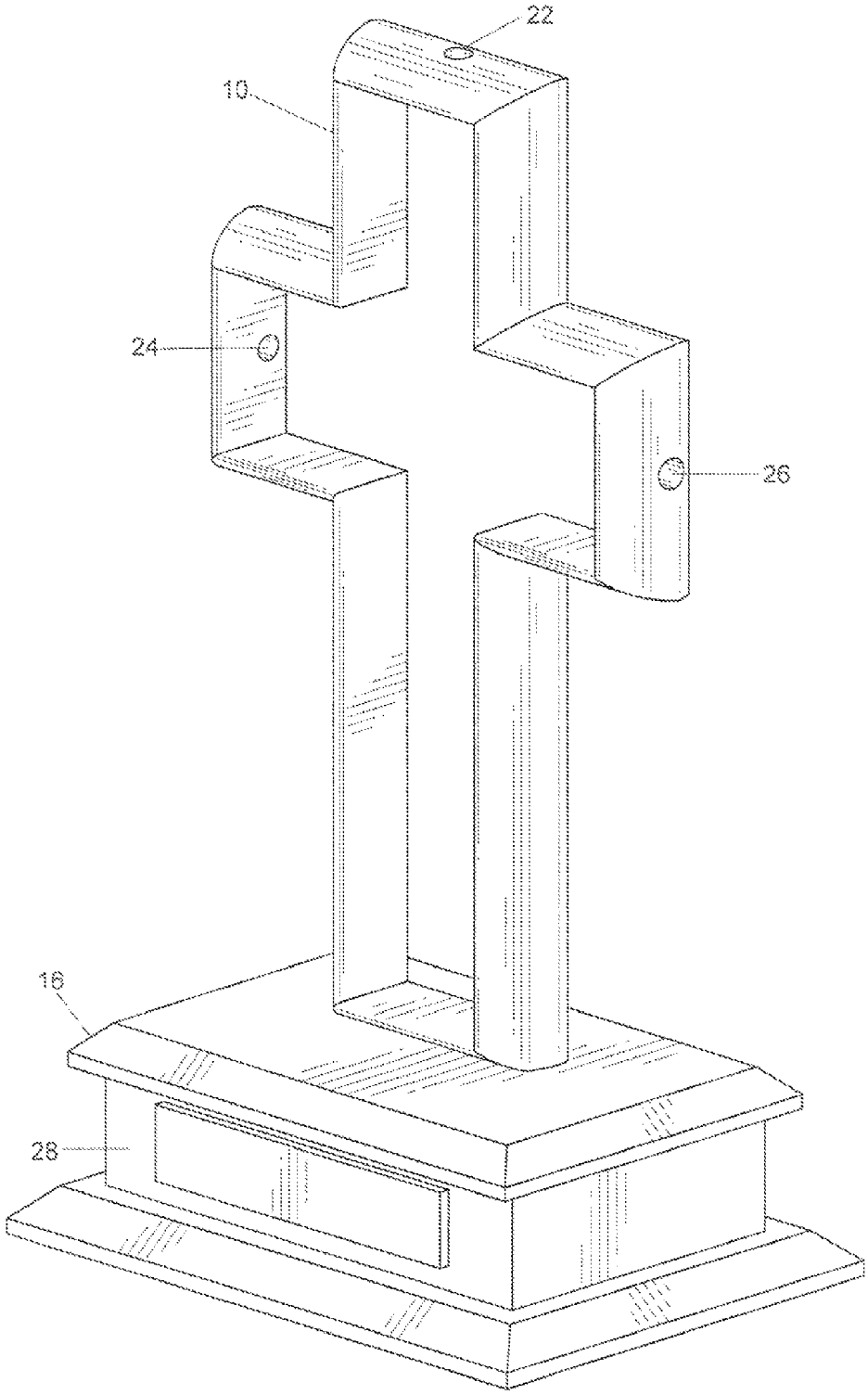
FIG. 3 illustrates a perspective view of the outer piece connected to the base of the multi-piece sculpture.

As shown in FIG. 2, a solid base 16 contains indented holes 18 and 20 through the top surface at the same positions as the pegs 12 and 14 at the bottom of the cross-shaped outer piece 10. This allows the outer piece 10 to connect into the base 16. One of the parties grasps the outer piece 10 and can insert the outer piece 10 into the base 16. The outer piece 10 is positioned to firmly fit into the solid base 16 by inserting the pegs 12 and 14 into the indented holes 18 and 20 of the solid base 16. FIG. 3 illustrates the outer piece 10 installed with the base 16. As an additional option, a small drawer 28 can temporarily be removed from the base 16.

Figure 7:
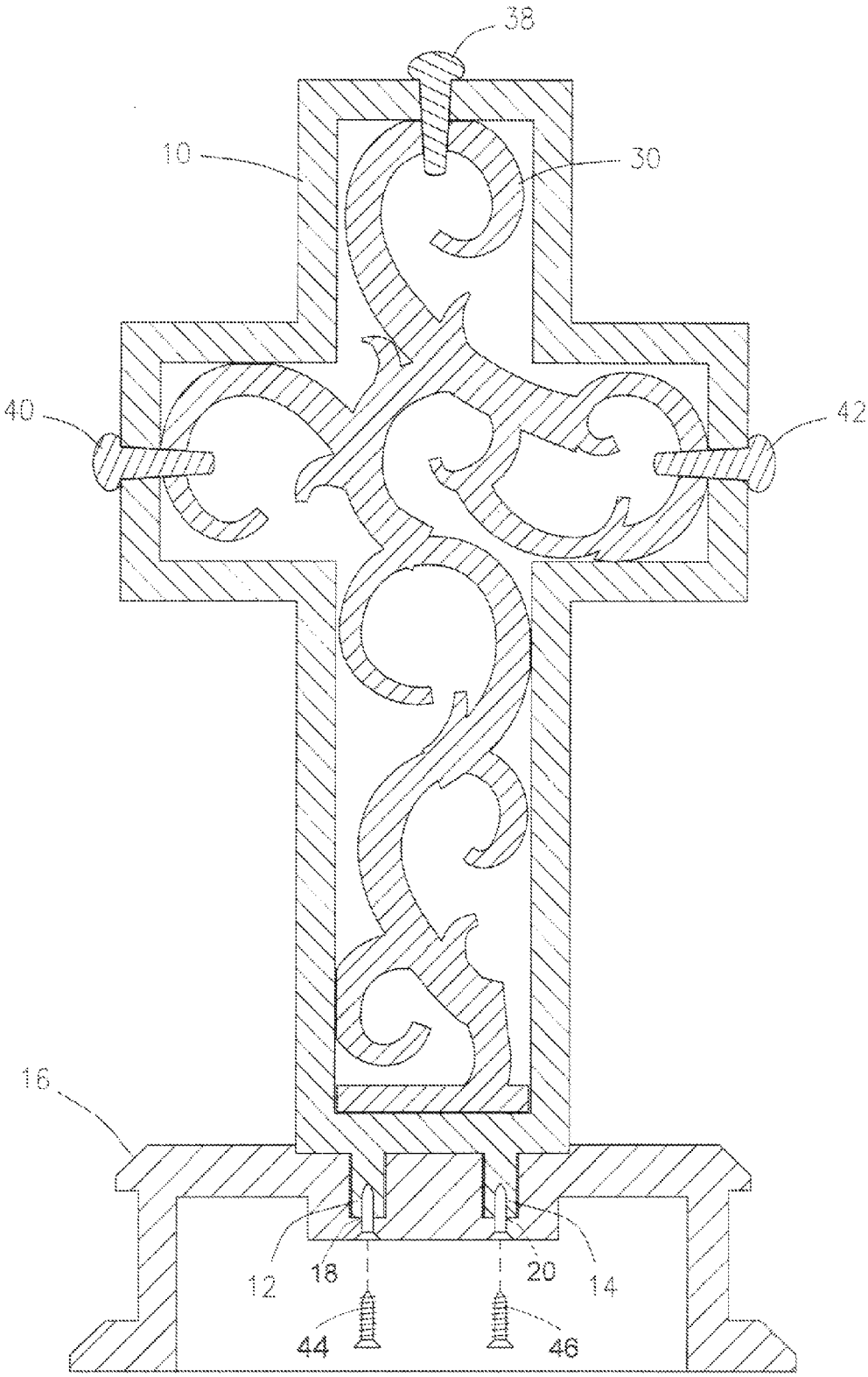
FIG. 7 illustrates a sectional view taken along section line 7-7 of FIG. 5.

FIG. 7 illustrates the sectional view of the assembled figure, and highlights the option to insert two screws 44 and 46 through the bottom of the base 16. A party can turn the assembly over and insert each screw 44 and 46 into the bottom of the indented holes 18 and 20 of the base. Each screw 44 and 46 enters through the base 16 and into pegs 12 and 14 at the bottom of the outer piece 10. The two screws 44 and 46 can fasten the cross-shaped outer piece 10 to the solid base 16 from the bottom of the base 16 platform. FIG. 3 also shows the cross-shaped piece 10 with openings on the top 22 and sides 24 and 26 attached to the base 16.

Figure 4:
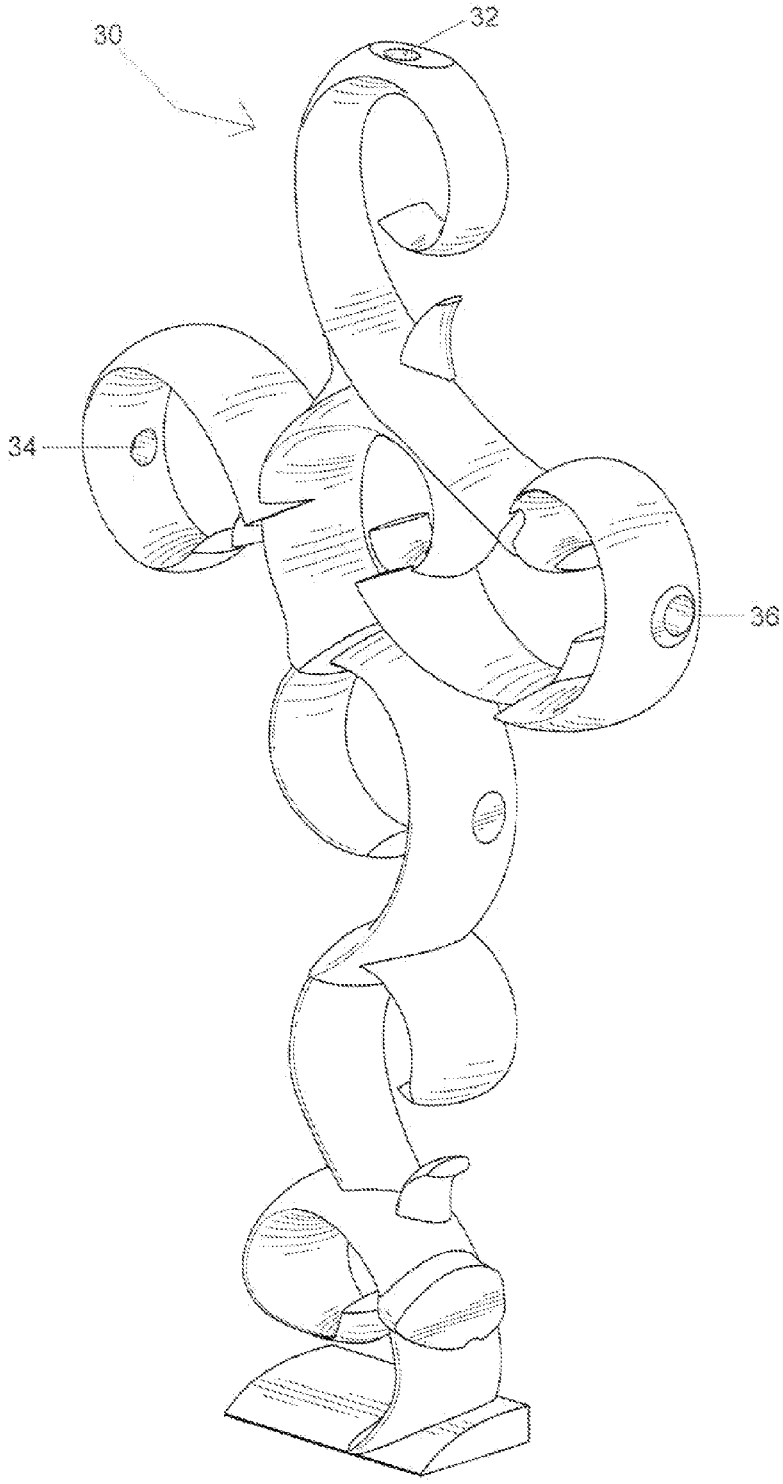
FIG. 4 illustrates a perspective view of an inner piece of the multi-piece sculpture.
Figure 5:
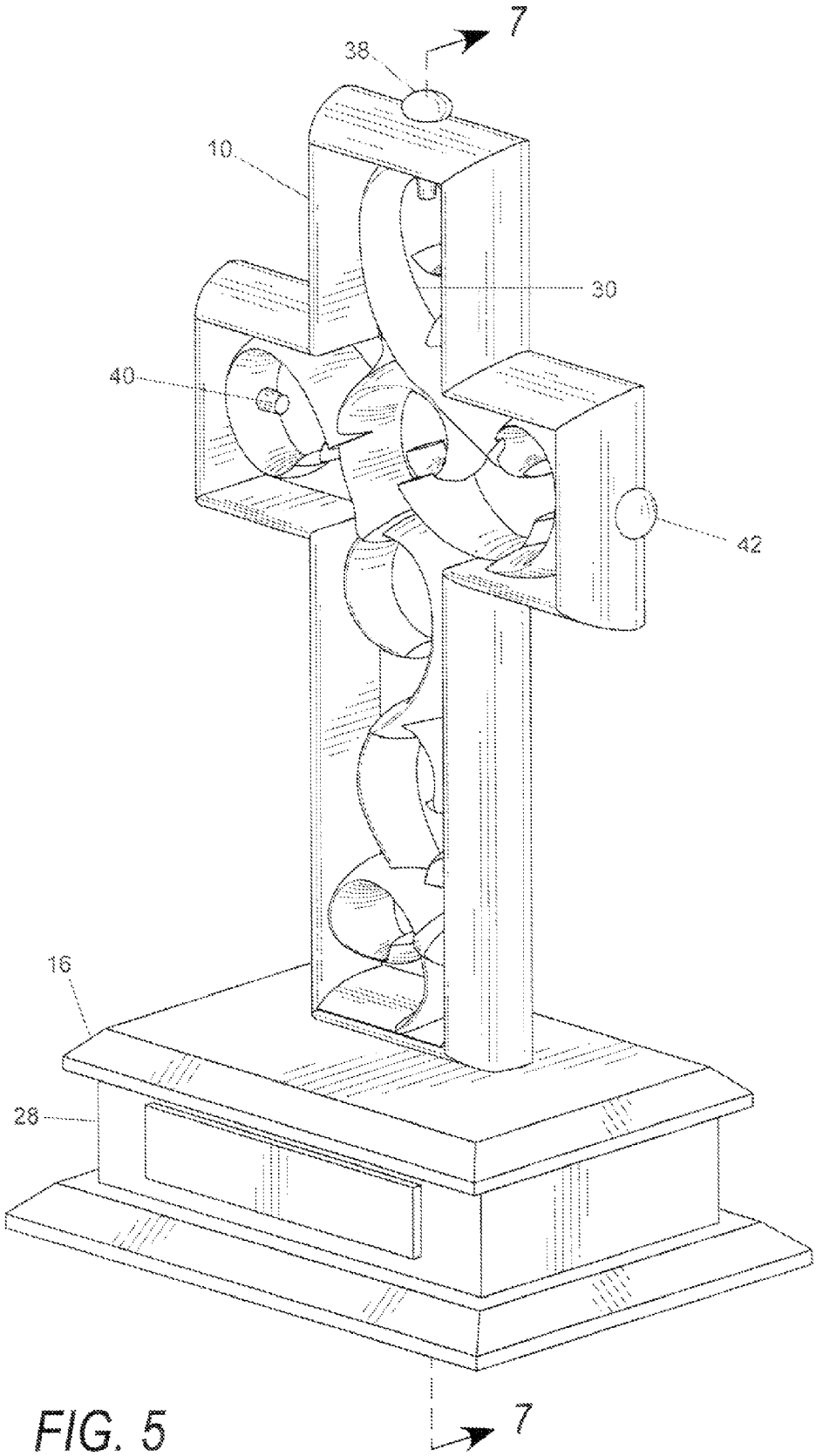
FIG. 5 illustrates a perspective view of the multi-piece sculpture after completion of the assembly.

As shown in FIG. 4, the inner piece 30 is intricately designed with scroll-like semi-circular designs, a flat base, and composed of a sturdy plastic material while also shaped like a cross. The inner piece 30 may be brought to the ceremony by the other participating party and could represent a "Woman" at a wedding ceremony. The inner piece 30 contains a circular opening on the top 32 and both of the sides 34 and 36 which will align with the openings of the outer piece 10, also shown in FIG. 4. The inner piece 30 is slightly smaller in width and height than the outer piece 10 so that the inner piece 30 may firmly fit within the outer piece 10. The inner piece 30 will be inserted within the outer piece by one party so that each of the openings 32-36 align with the outer openings 22-26. After the inner piece 30 has been inserted or fitted into the outer piece, a plastic plug 38 is inserted through the top openings 22 and 32, then plug 40 into the left openings of 24 and 34, and plug 42 into the right openings of 26 and 36. Plugs 38-42 will fasten the outer 10 and inner 30 pieces together, as shown in FIG. 5. These plugs 38-42 are composed of a sturdy plastic material in order to secure both the outer 10 and inner 30 pieces. Other types of fasteners may be used within the spirit and scope of the invention.

Figure 6:
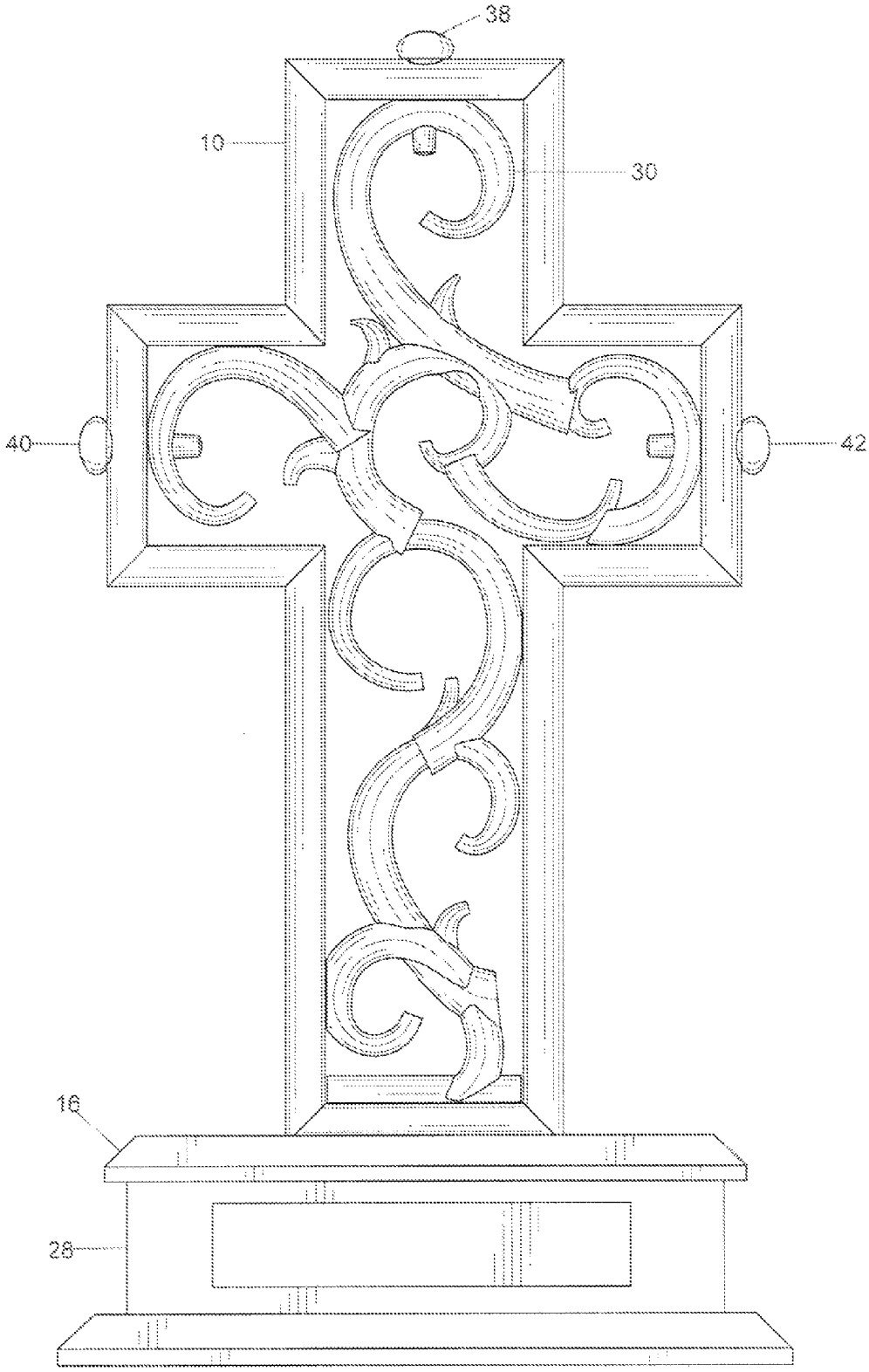
FIG. 6 illustrates a front view of the multi-piece sculpture shown in FIG. 5.

If the replaceable drawer 28 within the solid base 16 was removed, then the drawer 28 within the base 16 can be inserted into the base 16 in order to form the complete multi-piece sculpture assembly as shown in FIG. 6.

The inner piece 30 as the outer piece 10 may each be constructed and designed so that neither piece will be capable of standing alone. Without assembly, the individual piece appear to be incomplete.

FIG. 7 illustrates a sectional view of the complete assembly taken along sectional line 7-7 of FIG. 5 showing the plugs 38-42 penetrating through both the outer piece 10 and inner 30 pieces. FIG. 7 also shows the pegs 12 and 14 of the outer piece entering the indented holes 18 and 20 (not shown in FIG. 7) within the solid base 16 in order to fasten the two pieces together.

What is claimed is:

1. A method of assembling a ceremonial multi-piece sculpture representational of a union and commitment in a ritual-based ceremony, which comprises the steps of:

inserting a cross-shaped outer piece having a central open area onto a base, wherein said outer piece includes a front side and a back side and said central open area extends completely from said front side to said back side;

connecting the base to the outer piece;

inserting a cross-shaped inner piece within the central open area of the outer piece through the front side or the back side of the outer piece, the inner piece being slightly smaller than the outer piece; and fastening the inner piece to the outer piece completing said ceremonial sculpture.

2. A method of assembling a multi-piece sculpture as set forth in claim 1 wherein said outer piece is securely fastened into peg holes on a surface of the base.

3. A method of assembling a multi-piece sculpture as set forth in claim 1 wherein said outer piece is fastened with screws from a bottom of the base.

4. A method of assembling a multi-piece sculpture as set forth in claim 1 wherein said inner piece is inserted within said outer piece with openings of said outer and inner pieces aligned.

5. A method of assembling a multi-piece sculpture as set forth in claim 4 wherein said inner piece is fitted within said outer piece by plugs that are inserted into said openings of said outer and inner pieces.

6. A method of assembling a multi-piece sculpture as set forth in claim 1 wherein said outer piece is in a basic shape of a cross.

7. A method of assembling a multi-piece sculpture as set forth in claim 1 wherein said inner piece is in a shape of a cross with semi-circular designs.

8. A method of assembling a ceremonial multi-piece sculpture which comprises the steps of:

inserting a cross-shaped outer piece having a central open area onto a base, wherein said outer piece includes a front side and a back side and said central open area extends completely from said front side to said back side;

securely fastening the outer piece into peg holes on the surface of the base;

inserting an a cross-shaped inner piece within the central open area of the outer piece through the front side or the back side of the outer piece, wherein said inner piece is slightly smaller than the outer piece and is in the shape of a cross;

aligning openings of said inner piece with openings of said outer piece; and fastening the inner piece to the outer piece completing said ceremonial sculpture.

* * * * *